United States Patent [19]

Saiki

[11] 4,194,475

[45] Mar. 25, 1980

[54] INTERNAL COMBUSTION ENGINE WITH AN EXHAUST GAS RECIRCULATION SYSTEM

[75] Inventor: Junichi Saiki, Susono, Japan

[73] Assignee: Toyota Jidosha Kogyo Kabushiki Kaisha, Toyota, Japan

[21] Appl. No.: 918,381

[22] Filed: Jun. 23, 1978

[30] Foreign Application Priority Data

Apr. 25, 1978 [JP] Japan ..... 53-48326

[51] Int. Cl.[2] ..... F02M 25/06

[52] U.S. Cl. ..... 123/119 A

[58] Field of Search ..... 123/119 A, 127

[56] References Cited

U.S. PATENT DOCUMENTS

| | | | |
|---|---|---|---|
| 3,444,846 | 5/1969 | Sarto et al. | 123/119 A |
| 3,542,004 | 11/1970 | Cornelius | 123/119 A |
| 3,641,989 | 2/1972 | Hill | 123/119 A |
| 3,643,641 | 2/1972 | Busse | 123/119 A |
| 3,675,633 | 7/1972 | Nakajima et al. | 123/119 A |
| 3,908,618 | 9/1975 | Tange et al. | 123/119 A |
| 4,020,808 | 5/1977 | Yagi et al. | 123/119 A |
| 4,022,175 | 5/1977 | Laprade et al. | 123/119 A |
| 4,071,005 | 1/1978 | Nakasima et al. | 123/119 A |
| 4,072,133 | 2/1978 | McWhirter | 123/119 A |

*Primary Examiner*—Wendell E. Burns

*Attorney, Agent, or Firm*—Sevens, Davis Miller & Mosher

[57] ABSTRACT

Disclosed is an internal combustion engine with an exhaust gas recirculation system. The engine is provided with a carburetor which includes a primary system and a secondary system. The recirculated exhaust gas is supplied to the intake passage via an exhaust gas supply pipe which is disposed at a position downstream of the carburetor. The top end of the exhaust gas supply pipe is open at a space having a predetermined positional relationship with the wall of the primary system.

4 Claims, 6 Drawing Figures

INTERNAL COMBUSTION ENGINE WITH AN EXHAUST GAS RECIRCULATION SYSTEM

BACKGROUND OF THE INVENTION

This invention relates to an internal combustion engine with an exhaust gas recirculation system, more especially, to an internal combustion engine with an exhaust gas recirculation system which engine is provided with a specially-designed fuel preparation device.

Well known are exhaust gas recirculation engines which recirculate a part of the exhaust gas extracted from an exhaust system of the engine into an intake system of the engine of reducing harmful contaminants, especially nitrogen oxides ($NO_x$), contained in the exhaust gas. In these engines, the exhaust system and the intake system of the engine are communicated with each other via an exhaust gas recirculation control valve so that a part of the exhaust gas in the exhaust system is recirculated into the intake system in accordance with a predetermined program.

Many of the carburetors installed in the above-described well-known exhaust gas recirculation engines comprise a primary system and a secondary system. The entrance of such a carburetor is communicated with an intake air supply and the exit of the carburetor is communicated with a plurality of combustion chambers of the engine via an intake passage. The intake passage comprises an entrance portion connected to the exit of the carburetor and a plurality of exit portions which are branched from a branch portion of the intake passage and which communicate the entrance portion with the combustion chambers, respectively. An exhaust gas supply pipe is disposed on the wall of the intake passage at a position between the entrance portion and the branch portion and communicated with an exhaust gas recirculation control valve so that a part of the exhaust gas emitted from the combustion chambers is recirculated into the intake passage through the exhaust gas supply pipe.

The above-described conventional exhaust gas recirculation engine may cause a defect wherein the exhaust gas recirculation ratio, which is defined by a percentage of the weight of the recirculated exhaust gas to that of the intake air and normally called the "EGR ratio", becomes uneven between the combustion chambers, i.e., cylinders of the engine. As a result of the unevenness of the EGR ratio, when the amount of the recirculated exhaust gas is increased, some of the combustion chambers are supplied with more exhaust gas than other combustion chambers, and then a misfire due to the excessive exhaust gas is caused in those combustion chambers containing such excessive amounts of exhaust gas. As a result, amounts of harmful contaminants, especially carbon monoxides (CO) and hydrocarbons (HC), contained in the exhaust gas emitted from the engine are increased.

SUMMARY OF THE INVENTION

An object of the present invention is to provide an internal combustion engine with an exhaust gas recirculation system which can decrease the unevenness of the EGR ratio existing between the combustion chambers of the engine so that misfires can be prevented from occurring and the engine can be stably rotated, and then the degradation of the exhaust gas emission can be prevented.

Another object of the present invention is to provide an internal combustion engine with an exhaust gas recirculation system having an exhaust gas supply pipe, in which engine the exhaust gas supply pipe is open at a predetermined space located downstream of the carburetor so that the exhaust gas supplied from the exhaust gas supply pipe can be uniformly admixed with the combustible gas mixture supplied from the carburetor to the combustion chambers of the engine.

An embodiment of the present invention will now be explained with reference to the accompanying drawings.

DETAILED DESCRIPTION OF THE INVENTION

Figure 1:
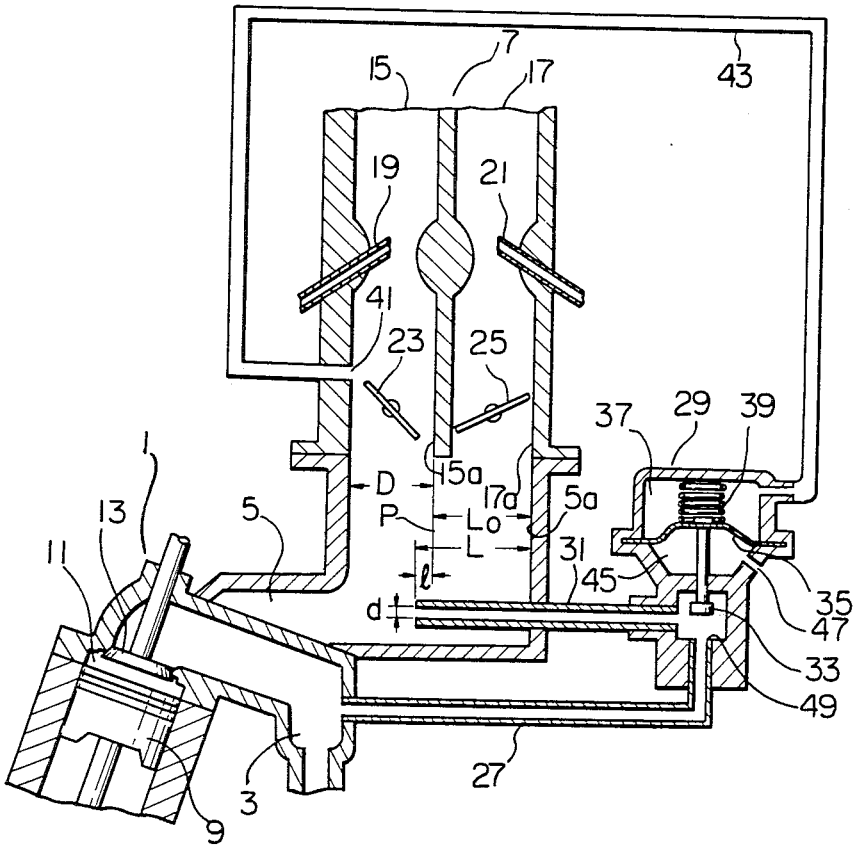
FIG. 1 is a schematic cross-sectional elevational view of an engine according to the present invention.
Figure 2:
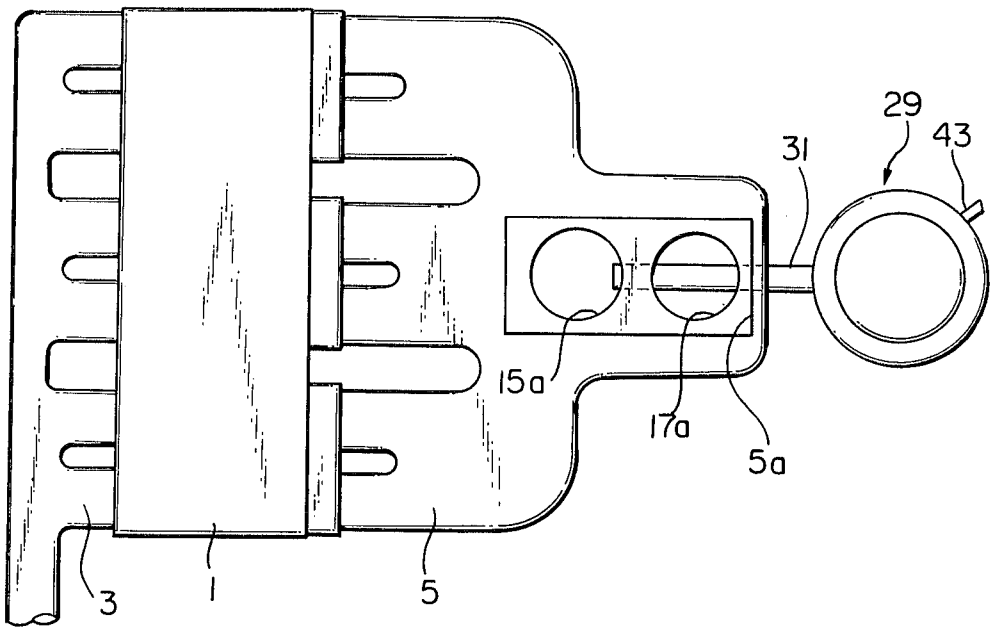
FIG. 2 is a plan view of the engine illustrated in FIG. 1; in this figure a carburetor is dismounted from the engine.

Referring to FIG. 2, a body of an internal combustion engine 1 is provided with an exhaust manifold 3 which is communicated with a muffler (not shown) via a catalytic converter (not shown). The internal combustion engine body 1 is further provided with an intake manifold 5 which is communicated with a carburetor 7 (FIG. 1). The internal combustion engine 1 comprises six combustion chambers 11 each of which has a piston 9 slidably and sealingly mounted therein as illustrated in FIG. 1. The six combustion chambers 11 are disposed parallel to each other and separated from each other in a direction corresponding to the vertical direction of FIG. 2, i.e., in a direction perpendicular to the sheet on which FIG. 1 is illustrated. The combustion chambers 11 (FIG. 1) are respectively called a first cylinder, a second cylinder and so on in that sequential order from the bottom to the top as shown in FIG. 2. Referring to FIG. 1 again, the inlet ends of the exhaust manifold 3 are communicated with the respective combustion chambers 11 via respective exhaust valves 13 which are operated in synchronization with the rotation of a crankshaft (not shown) of the engine 1. The outlet ends of the intake manifold 5 are communicated with the respective combustion chambers 11 via intake valves (not shown) which are operated in synchronization with the rotation of the crankshaft (not shown) of the engine 1.

With reference to FIG. 1, the carburetor 7 comprises a primary system 15 and a secondary system 17. The primary system 15 and the secondary system 17 are communicated with an intake air supply such as an air cleaner (not shown), respectively, and are communicated with a fuel supply (not shown) via fuel jets 19 and 21, respectively. Furthermore, the primary system 15 and the secondary system 17 have throttle valves 23 and 25 swingably pivoted therein, respectively, so that the throttle valves 23 and 25 are swung in synchronization with the stepping operation of the accelerator gas pedal. The primary system 15 is located nearer to the engine body 1 than the secondary system 17, and the internal diameter of the throttle bore of the primary system 15 is expressed as D (in mm). The secondary system 17 is located adjacent to the primary system 15 so that it is located far from the engine body 1. The distance between the wall 17*a* of the secondary system 17, which wall is located farthest from the engine body 1, and the wall 15a of the primary system 15, which wall is also located farthest from the engine body 1, is expressed as $L_O$ (in mm).

The exhaust manifold 3 is communicated with the intake manifold 5 via an exhaust gas recirculation pipe 27, an exhaust gas recirculation control valve 29 and an exhaust gas supply pipe 31. Downstream of a space where the exhaust gas supply pipe is open, the intake manifold 5 is branched into six exit portions. The exhaust gas recirculation control valve 29 comprises a valve body 33 and a diaphragm 35 on which the valve body 33 is fixed. An upper chamber 37 partitioned by the diaphragm 35 has a compression spring 39 mounted therein for urging the diaphragm 35, and the upper chamber 37 is communicated with an EGR port 41, located near to the throttle valve 23 of the primary system 15, via a communicating pipe 43. A lower chamber 45 partitioned by the diaphragm 35 has an opening 47 formed on the wall thereof so that the lower chamber 45 is communicated with the outside via the opening 47. As a result of the above-mentioned construction, the valve body 33 is vertically moved in accordance with change in the pressure supplied from the EGR port 41, and then, the valve body cooperates with a valve seat 49 so that the amount of the recirculated exhaust gas is controlled in accordance with a predetermined program. It should be noted that other exhaust gas recirculation control valves, for example, an exhaust gas recirculation control valve with a modulator valve (not shown), can be utilized.

The exhaust gas supply pipe 31 projects from the wall 5*a* of the intake manifold 5 to a space located below the primary system 15 where the top end of the exhaust gas supply pipe 31 is open. The length of the exhaust gas supply pipe 31 projecting from the wall 5*a* of the intake manifold 5 is expressed as L (in mm). This means that the exhaust gas supply pipe 31 projects from the prolongation P of the wall 15*a* of the primary system 15 by an amount l (in mm) equal to the difference between the lengths L (in mm) and $L_O$ (in mm).

In the present invention, the top end of the exhaust gas supply pipe 31 is located at a predetermined position which has a special positional relationship with the primary system 15 of the carburetor 7 so that the recirculated exhaust gas is uniformly admixed with the taken-in air fuel mixture. As a result, unevenness of the EGR ratio existing between the cylinders is decreased. Especially, evenness of the EGR ratio existing between the cylinders can be achieved, while the engine rotating speed is low and while the primary system 15 is principally used to prepare the gas mixture. As a result of the EGR ratio evenness, even when a large amount of the exhaust gas is recirculated, the engine can rotate stably without causing any misfire. In addition, since exhaust gas having a certan temperature is supplied at a space located near to the primary system 15 of the carburetor 7, the atomization and the vaporization of the fuel admixed in the intake air is facilitated, and then an advantage wherein the gas mixture becomes more uniform can be achieved. This advantage is remarkably achieved when the throttle bore diameter of the primary system 15 of the carburetor 7 is large. Accordingly, the engine of the present invention can reduce more nitrogen oxides contained in the exhaust gas than can the conventional engine, because in the engine of the present invention a large amount of exhaust gas can be recirculated.

The preferable range of the dimensions of the space will now be explained with reference to the data obtained in the following Example.

EXAMPLE

Figure 3:
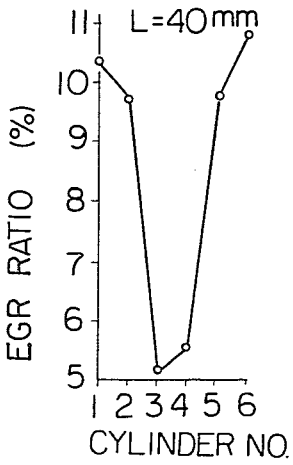
FIGS. 3 through 5 are diagrams representing the distribution of the EGR ratio existing between the cylinders of an engine.
Figure 4:
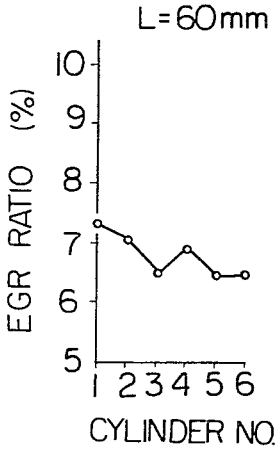
Figure 5:
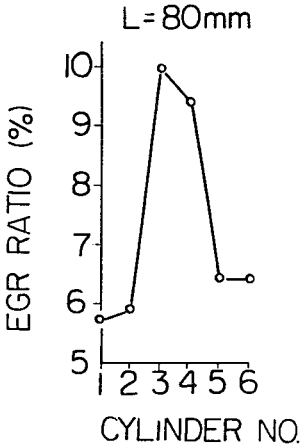

In the engine illustrated in FIG. 1, the projecting length L (in mm) of the exhaust gas supply pipe 31 was varied, and then the unevenness of the EGR ratio existing between the cylinders was measured. The measured data are plotted in FIGS. 3 through 5. In FIGS. 3 through 5, the cylinder number is plotted on the abscissa and the EGR ratio is plotted on the ordinate. The internal diameter d of the exhaust gas supply pipe was 16 mm; the rotating speed of the engine was 2000 rpm; $L_O$ was 60 mm; and D was 38 mm.

FIG. 3 shows that, when the top end of the exhaust gas supply pipe 31 is located far away and does not reach the prolongation P of the wall 15*a* of the primary system 15 of the carburetor 7, the EGR ratios of the third and fourth cylinders centrally located in the engine are very small and those of the other cylinders are large. The inventor of this invention believes that this is due to the fact that the gas mixture is supplied to the third and fourth cylinders without being admixed well with the recirculated exhaust gas.

As illustrated in FIG. 4, when L is equal to $L_O$, i.e., when the top end of the exhaust gas supply pipe 31 is located on the prolongation P of the wall 15*a* of the primary system 15 of the carburetor 7, unevenness of the EGR ratio is remarkably reduced.

When the top end of the exhaust gas supply pipe 31 is further projected toward the center of the primary system 15, the EGR ratios of the third and fourth cylinders centrally located in the engine are remarkably large and those of the other cylinders are small. This is because, according to the inventor's opinion, almost all of the recirculated exhaust gas is transferred together with the gas mixture flowing from the primary system 15 to the centrally located cylinders.

Figure 6:
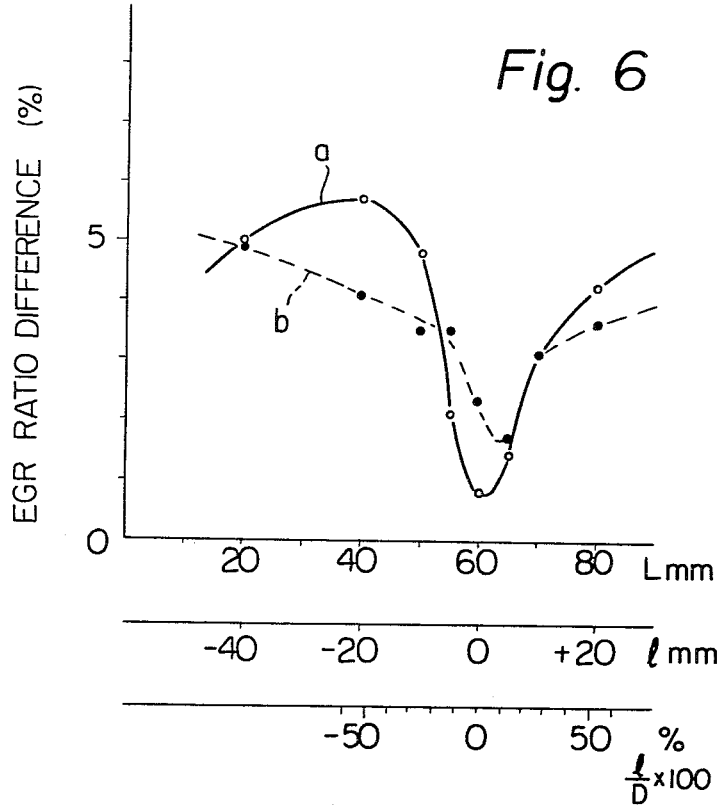
FIG. 6 is a diagram showing the relationships between the length of the exhaust gas supply pipe projection and the amount of unevenness of the EGR ratio existing between the cylinders of the engine.

FIG. 6, the projecting length of the exhaust gas supply pipe 31 is plotted on the abscissa and the EGR ratio difference between the cylinders is plotted on the ordinate. The EGR ratio difference is the difference between the maximum EGR ratio and the minimum EGR ratio of the engine under the same condition. In FIG. 6, the solid curve "a" illustrates the EGR ratio difference characteristic when the engine rotating speed is 2000 rpm, and the broken line "b" illustrates the EGR ratio difference characteristic when the engine speed is 2800 rpm. From FIG. 6, it is concluded that, when the top end of the exhaust gas supply pipe 31 is open to a predetermined space, the EGR ratio difference can be remarkably reduced. When values of the distance l (in mm) measured from the prolongation P of the wall 15*a* of the primary system 15, the internal diameter D (in mm) of the throttle bore of the primary system 15 and the percentage of l to D, i.e., $l/D \times 100$, are used, the preferable range of the dimension of the predetermined space is between $-30\%$ and $+30\%$, more preferably, the range is between $-15\%$ and $+15\%$. The plus symbol (+) means that the distance l (in mm) is measured in a direction toward the center of the primary system 15 from the prolongation P and the minus symbol (−)

means that the distance l (in mm) is measured in a direction toward the wall 17*a* of the secondary system 17 on which the exhaust gas supply pipe 31 is disposed.

The above explanation was provided with regard to a six-cylinder engine; however, the present invention is applicable to engines which have more than or less than six cylinders, for example, a four-cylinder engine or an eight-cylinder engine. In some cases, the primary system of the carburetor can be located farther from the engine body than the secondary system.

What we claim is:

1. An internal combustion engine with an exhaust gas recirculation system comprising:

a carburetor which is communicated with an intake air supply and provided with a primary system and a secondary system;

an intake passage, the entrance portion of which being communicated with said carburetor and which is branched into a plurality of exit portions at the branch portion thereof, said exit portions being communicated with combustion chambers of said engine, respectively;

an exhaust passage which is communicated with said engine for discharging the exhaust gas;

an exhaust gas supply pipe which is disposed on a wall of the intake passage located between said entrance portion and said branch portion and communicated with said exhaust passage for recirculating a part of the exhaust gas, the top end of said exhaust gas supply pipe projecting from said wall and being opened to a space having a predetermined positional relationship with the prolongation of a wall of said primary system; and said primary system of said carburetor is located nearer to an engine body than said secondary system, said secondary system of said carburetor is located adjacent to said primary system, and said wall on which said exhaust gas supply pipe is disposed is located farther from said engine body than said primary system.

2. An internal combustion engine according to claim 1 which further comprises an exhaust gas recirculation valve located between said exhaust passage and said exhaust gas supply pipe for controlling the circulation of the exhaust gas.

3. An internal combustion engine according to claim 1 or 2, wherein the value of $100 \times l/D$ is in a range of between $-30\%$ and $+30\%$:

wherein l (in mm) is the distance between said prolongation and said top end of said exhaust gas supply pipe measured along a line perpendicular to said prolongation and in a direction toward the center of said primary system, and;

D (in mm) is the internal diameter of said primary system.

4. An internal combustion engine according to claim 3, wherein said value of $100 \times l/D$ is in a range of between $-15\%$ and $+15\%$.

* * * * *